US006711905B2

(12) United States Patent
Howard

(10) Patent No.: US 6,711,905 B2
(45) Date of Patent: Mar. 30, 2004

(54) ACOUSTICALLY ISOLATED HEAT EXCHANGER FOR THERMOACOUSTIC ENGINE

(75) Inventor: Robert J. Howard, Clifton, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/407,612

(22) Filed: Apr. 4, 2003

(65) Prior Publication Data

US 2003/0188541 A1 Oct. 9, 2003

Related U.S. Application Data

(60) Provisional application No. 60/369,760, filed on Apr. 5, 2002.

(51) Int. Cl.[7] ..... F25B 9/00; F01K 1/00

(52) U.S. Cl. ..... 62/6; 60/520

(58) Field of Search ..... 62/6, 498, 467; 60/520

(56) References Cited

U.S. PATENT DOCUMENTS

| | | | | |
|---|---|---|---|---|
| 4,397,398 A | | 8/1983 | Watanabe | |
| 4,584,840 A | | 4/1986 | Baumann | |
| 4,717,405 A | | 1/1988 | Budliger | |
| 5,174,130 A | * | 12/1992 | Lucas | 62/498 |
| 5,263,341 A | * | 11/1993 | Lucas | 62/498 |
| 5,339,640 A | * | 8/1994 | Reinke | 62/6 |
| 5,813,234 A | * | 9/1998 | Wighard | 62/6 |
| 5,953,921 A | * | 9/1999 | Garrett | 62/6 |
| 5,996,345 A | | 12/1999 | Hofler | |
| 6,059,020 A | | 5/2000 | Jairazbhoy et al. | |
| 6,164,073 A | * | 12/2000 | Swift et al. | 60/721 |
| 6,210,128 B1 | | 4/2001 | Rife et al. | |
| 6,314,740 B1 | | 11/2001 | De Blok et al. | |
| 6,560,970 B1 | * | 5/2003 | Swift | 62/6 |

FOREIGN PATENT DOCUMENTS

JP 8-14679 1/1996

OTHER PUBLICATIONS

Lawrence E. Kinsler, et al.,"Fundamentals of Acoustics" at p. 216–223 (3d ed. John Wiley & Sons 1982).

* cited by examiner

*Primary Examiner*—William C. Doerrler
(74) *Attorney, Agent, or Firm*—Dicke, Billig & Czaja, PLLC

(57) ABSTRACT

A thermoacoustic engine for acoustically driving a thermal exchange includes a hollow drive tube, a heat transfer medium, an acoustic resonator, and a first thermal element. The hollow drive tube partially contains the heat transfer medium and is connected to and opens into the acoustic resonator. The acoustic resonator is adapted to store acoustic energy and deliver at least one acoustic wave to the heat transfer medium. The first thermal element includes a first channel and a first working fluid. The first channel is positioned to cross and open into the hollow drive tube, at least partially contains the first working fluid, and is sized to decrease the propagation of the at least one acoustic wave within the first channel. The first thermal working fluid is adapted to interact with and undergo thermal exchange with the heat transfer medium by conduction.

22 Claims, 4 Drawing Sheets

ACOUSTICALLY ISOLATED HEAT EXCHANGER FOR THERMOACOUSTIC ENGINE

CROSS REFERENCE TO RELATED APPLICATIONS

This Non-Provisional Utility Patent Application claims the benefit of the filing date of U.S. Provisional Application Ser. No. 60/369,760, filed Apr. 5, 2002, entitled "ACOUSTICALLY ISOLATED HEAT EXCHANGER FOR THERMOACOUSTIC ENGINE."

THE FIELD OF THE INVENTION

The present invention relates to a thermoacoustic engine for converting acoustic energy to thermal energy or for converting thermal energy to acoustic energy. More particularly, the present invention relates to a thermoacoustic engine with an acoustically isolated heat exchanger.

BACKGROUND OF THE INVENTION

Thermoacoustic engines have developed as an attractive alternative to more traditional piston and turbine devices for heating, cooling, and electric power generation applications. Thermoacoustic engines are generally highly reliable due to the limited number of moving parts and the abrogated need for lubrication. Furthermore, thermoacoustic systems are environmentally friendly as they can utilize air or a noble gas as a heat transfer medium and working fluid rather than poisonous or ozone layer damaging substances, such as FREON, which are commonly used in conventional piston and turbine devices. In what follows the terms heat transfer medium and working fluid will be used interchangeably for brevity, unless otherwise indicated.

FIG. 1 illustrates a typical thermoacoustic engine 10 including an acoustic resonator 12 and a drive tube 14. Drive tube 14 is a hollow, elongated member typically having a closed end 16 and an open end 18. Open end 18 is connected or sealed to acoustic resonator 12. Drive tube 14 contains a first thermal element 20, a regenerator 24, and a second thermal element 22. As illustrated, first thermal element 20 is positioned further from acoustic resonator 12 than second thermal element 22, and regenerator 24 is positioned between first thermal element 20 and second thermal element 22. First thermal element 20 is commonly a heat source and second thermal element 22 is commonly a heat sink. Acoustic resonator 12 and drive tube 14 are generally filled with a heat transfer medium 26, which is typically air or a noble gas. Heat transfer medium 26 flows through and between first thermal element 20, regenerator 24, and second thermal element 22 to facilitate thermal exchange.

During operation, heat is supplied to first thermal element 20 while heat is simultaneously removed from second thermal element 22 to establish a sufficient temperature gradient across regenerator 24 to activate thermoacoustic engine 10. Upon activation, thermoacoustic engine 10 may function as a Carnot engine in which first thermal element 20 is heated to induce movement in heat transfer medium 26 to produce a high intensity sound in acoustic resonator 12. Alternatively, acoustic energy is introduced to heat transfer medium 26 which is employed to establish thermal transition from the cold sink, i.e., second thermal element 22, across regenerator 24, to the heat source, i.e., first thermal element 20, to function as a refrigerator.

Typical thermoacoustic engines, such as thermoacoustic engine 10, depend on thermal conduction through the drive tube walls at first and second thermal elements 20 and 22. In particular, heat exchangers or electric elements are commonly attached to the inside or outside of the drive tube 14, such as at the first and/or second thermal elements 20, 22 located within drive tube 14, to add or remove heat from the respective elements.

The typical thermoacoustic engines have low thermal efficiency, low power density, and tend to be significantly larger than their piston or turbine driven counterparts. A significant factor contributing to the aforementioned disadvantages of thermoacoustic engines is a difficulty in supplying or removing heat to or from the active areas or thermal elements of the thermoacoustic engine while maintaining acceptable acoustic losses.

To avoid the shortcomings of the above-discussed thermoacoustic engines and for other reasons presented in the Description of the Preferred Embodiments, a need exists for a thermoacoustic engine which supplies and removes heat from the respective portions of the drive tube in a more efficient manner so as to maintain acceptable levels of acoustic losses.

SUMMARY OF THE INVENTION

One aspect of the present invention provides a thermoacoustic engine for acoustically driving a thermal exchange. The thermoacoustic engine includes a hollow drive tube, a heat transfer medium, an acoustic resonator, and a first thermal element. The hollow drive tube partially contains the heat transfer medium and is connected to and opens into the acoustic resonator. The acoustic resonator is adapted to store acoustic energy and deliver at least one acoustic wave to the heat transfer medium. The first thermal element includes a first channel and a first working fluid. The first channel is positioned to cross and open into the hollow drive tube, at least partially contains the first working fluid, and is sized to decrease the propagation of the at least one acoustic wave within the first channel. The first thermal working fluid is adapted to interact with and undergo thermal exchange with the heat transfer medium by conduction.

In one embodiment, the first channel is sized to procure exponential decay of the acoustic waves within the first channel. Additionally, the first channel has a duct-cut off frequency smaller than a frequency of the hollow drive tube (i.e. a critical dimension smaller than a dimension required for propagation of the at least one acoustic wave). In one embodiment, the first thermal element further includes an external heat exchanger connected and open to a first end and a second end of the first channel. The heat exchanger is adapted to alter the thermal energy of the first working fluid.

In another embodiment, the thermoacoustic engine further includes a second thermal element spaced from the first thermal element. The second thermal element includes a second channel at least partially containing a second working fluid. The second channel is positioned to cross and open into the hollow drive tube and is sized to decrease propagation of the at least one acoustic wave within the second channel. The second working fluid is adapted to interact and undergo thermal exchange within the heat transfer medium.

Another aspect of the present invention provides a thermoacoustic engine for producing at least one acoustic wave. The thermoacoustic engine includes a drive tube, an acoustic resonator, a heat transfer medium, a first thermal element, and a second thermal element. The drive tube is connected to and opens into the acoustic resonator, and the drive tube and acoustic resonator contain the heat transfer medium. The first thermal element includes a first channel positioned to cross and opens into the drive tube. The first working fluid is at least partially contained in the first channel and is adapted to interact and undergo thermal exchange with the heat transfer medium by conduction. The second thermal element is spaced from the first thermal element and is adapted to induce thermal exchange between the second working fluid and the heat transfer medium. Thermal exchange between the first thermal element and the heat transfer medium and between the second thermal element and the heat transfer medium produces an acoustic wave in the heat transfer medium. The first channel is sized to decrease propagation of the acoustic wave within the first channel.

Another aspect of the present invention provides a method of acoustical thermal exchange. The acoustical method includes providing a thermoacoustic engine, inducing an acoustic wave, and exchanging thermal energy. The thermoacoustic engine provided includes a drive tube, a heat transfer medium contained in the drive tube, a first channel, and a first working fluid at least partially contained in the first channel. The first channel is positioned to cross and open into the drive tube. Introducing an acoustic wave to the drive tube induces flow within the heat transfer medium. The first channel is sized to decrease propagation of the acoustic wave within the first channel. Exchanging thermal energy occurs between the heat transfer medium and the first working fluid by conduction.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
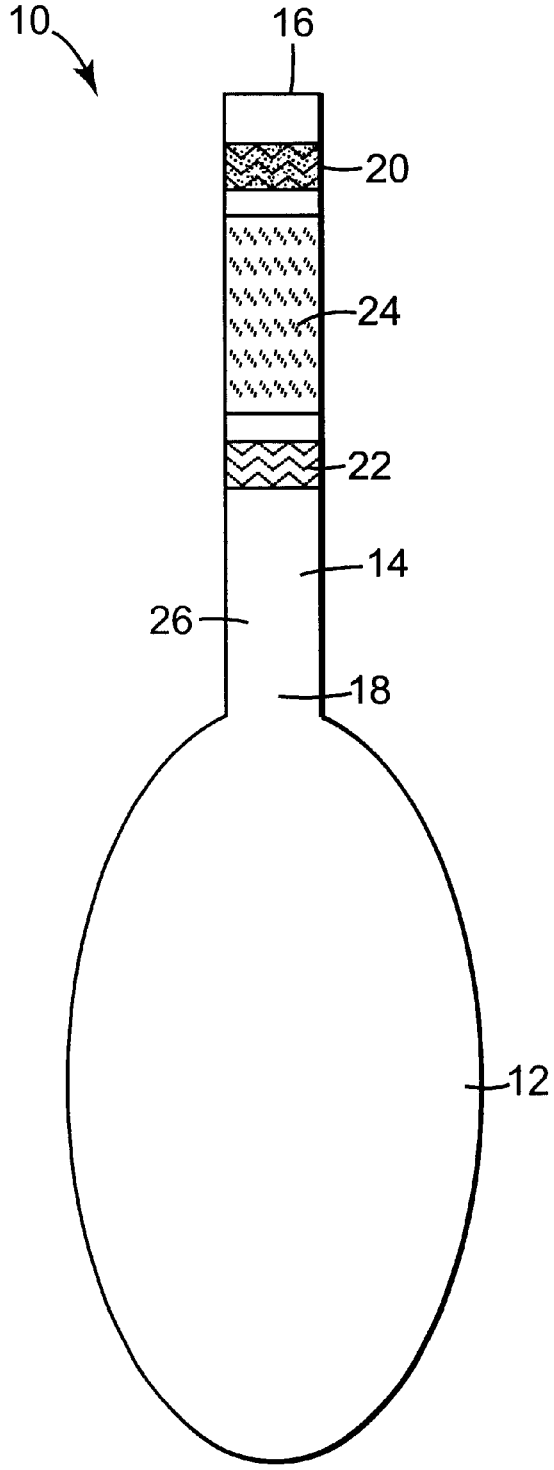
Fig. 1 (PRIOR ART)
FIG. 1 is a schematic illustration of a conventional thermoacoustic engine.
Figure 2:
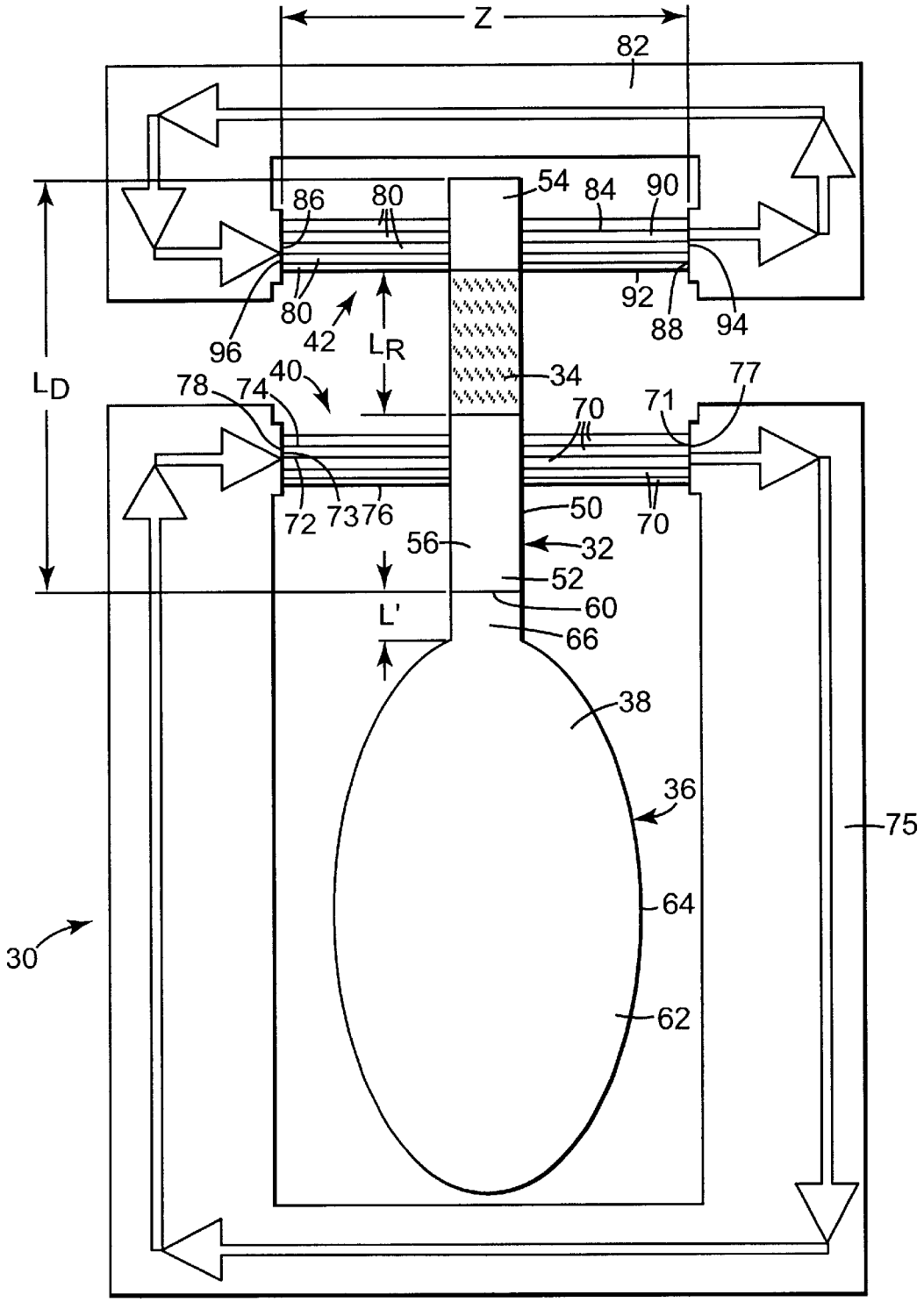
FIG. 2 is a schematic illustration of one embodiment of a thermoacoustic engine in accordance with the present invention.

FIG. 2 generally illustrates a thermoacoustic engine 30 for converting thermal energy to acoustic energy or for converting acoustic energy to thermal energy in accordance with the present invention. Generally speaking, thermoacoustic engine 30 includes a drive tube 32, a regenerator 34, an acoustic resonator 36, a heat transfer medium 38, a first thermal element 40, and a second thermal element 42. Regenerator 34 is contained within drive tube 32, and drive tube 32 is connected to and opens into acoustic resonator 36. Drive tube 32 and acoustic resonator 36 contain heat transfer medium 38. First thermal element 40 and second thermal element 42 are each positioned to open into drive tube 32 on either side of regenerator 34.

During operation, an acoustic wave is introduced to thermoacoustic engine 30. Acoustic resonator 36 stores acoustic energy from the acoustic wave and delivers acoustic energy back to heat transfer medium 38, thereby, imparting oscillatory motion into heat transfer medium 38. The oscillatory flow establishes a standing wave in heat transfer medium 38 through drive tube 32. In particular, heat transfer medium moves in a circuit through the thermal elements 40 and 42 and drive tube 32 by convection. As heat transfer medium 38 passes through first thermal element 40, first thermal element 40 transmits heat to or removes heat from heat transfer medium 38 by conduction. Heat transfer medium 38 continues from first thermal element 40 and is entrained in the standing acoustic wave in the drive tube 32, delivering heat to regenerator 34 and through second thermal element 42. As heat transfer medium 38 passes regenerator 34 and into second thermal element 42, second thermal element 42 delivers heat to or removes heat from heat transfer medium 38, preferably performing the opposite thermal exchange as first thermal element 40.

In one preferred embodiment, drive tube 32 is an elongated, hollow member as is known in the art. Drive tube 32 includes a wall 50 and defines a proximal end 52, a distal end 54, and a hollow cavity 56. Wall 50 extends between proximal end 52 and distal end 54 and encompasses hollow cavity 56. In one embodiment, wall 50 is open at proximal end 52 and closed or capped at distal end 54. Regenerator 34 is contained within hollow cavity 56. Preferably, regenerator 34 is positioned within hollow cavity 56 nearer distal end 54 than proximal end 52. Preferably, regenerator 34 is a regenerative stack, as is known in the art, such as a stack of metal or other material chosen to have an appropriate thickness, thermal capacity, thermal conductivity, and separation to maximize thermal and acoustic efficiency. In one embodiment, regenerator 34 has a high lateral thermal conductivity and a low conductivity along the length of the tube. Regenerator 34 is designed to allow incoming heat transfer medium 38 to oscillate back and forth across the regenerator 34 to heat or cool internal surfaces (not shown) of regenerator 34. The heated or cooled internal surfaces serve to further heat or cool outgoing heat transfer medium 38 as it is directed towards second thermal element 42.

Proximal end 52 of drive tube 32 is connected and open to acoustic resonator 36. Acoustic resonator 36 is a hollow, preferably metallic, container for storing acoustic energy and delivering acoustic energy to heat transfer medium 38. Acoustic resonator 36 includes an opening 56 to receive proximal end 52 of drive tube 32, such that heat transfer medium 38 can flow freely between acoustic resonator 36 and drive tube 32. Preferably, drive tube 32 is sealed to acoustic resonator 36 to prevent leakage of heat transfer medium 38 from the connection between drive tube 32 and acoustic resonator 36. Acoustic resonator 36 defines a cavity 62 and is adapted to store and deliver acoustic energy from an intense or large amplitude acoustic wave to heat transfer medium 38. As is known in the art, the acoustic energy will induce an oscillatory flow in heat transfer medium 38 and, consequently, will drive a standing wave in heat transfer medium 38 through drive tube 32 between proximal end 52 and distal end 54.

In one embodiment, acoustic resonator 36 is a Helmholtz resonator as is known in the art. The Helmholtz resonator is a rigid-walled volume that supports an acoustic wave having an acoustic wavelength larger than a wavelength typically implied by the dimensions of acoustic resonator 36. Typically, Helmholtz resonators have a main body 64 and a neck 66 leading to drive tube 32. Helmholtz resonators involve bulk fluid flow (as opposed to standing waves in the resonator body) and, therefore, require additional considerations in the design of first and second thermal elements as described in detail below.

Heat transfer medium 38 flows within and fills drive tube 32 and acoustic resonator 36. Heat transfer medium 38 is any heat transfer medium known in the art for use with acoustic resonators. For example, heat transfer medium 38 may be a compressible thermodynamic fluid. In a preferred embodiment, heat transfer medium 38 is air or an environmentally friendly noble gas.

In one embodiment, in which distal end 54 of drive tube 32 is capped, the acoustic wave, and therefore heat transfer medium 38, travels through drive tube 32 and is reflected back towards acoustic resonator 36 as a standing wave. In an alternative embodiment, a loop (not shown) is added to distal end 54 and the acoustic wave and heat transfer medium 38 travels from acoustic resonator 36 through drive tube 32 and back around to acoustic resonator 36. The looped acoustic wave forms a traveling wave in heat transfer medium 38 and lessens reliance upon acoustic resonator 36. The remaining description focuses on the use of standing waves, however, modifying thermal acoustic engine 30 to utilize traveling waves, as apparent to those of ordinary skill in the art, is equally acceptable.

In one embodiment, first thermal element 36 includes a first branch or channel 70 and a working fluid 72. First channel 70 is an elongated hollow member that defines a first channel cavity 74 and an external surface or first channel wall 76. Working fluid 72 is similar to heat transfer medium and at least partially contained within cavity 74, such that working fluid 72 can flow through first channel cavity 74. Notably, the distinction between heat transfer medium 38 and first working fluid 72 is a temporal description such that at a given instance in time, the heat transfer medium is the fluid contained in the drive tube 32 and first working fluid 72 is the fluid contained in first channel 70. In actuality, heat transfer medium 38 and first working fluid 72 freely interact and interchange with one another. First channel 70 crosses, connects, and opens to drive tube 32. More particularly, first channel wall 76 connects to and opens to drive tube 32 proximal to regenerator 34 and distal to acoustic resonator 36. In one embodiment, first channel wall 76 opens to drive tube 32 nearer regenerator 34 than acoustic resonator 36.

In one embodiment, first working fluid 72 is heated or cooled such that first channel 70 functions as an external heat exchanger or a portion of an external heat exchanger. In one embodiment, first channel 70 includes a first end 71 and a second end 73 opposite first end 71. In this embodiment, first thermal element 36 further includes a heat exchanger 75, which can be implemented with any suitable heat exchanger known in the art defining an internal cavity (not shown), an inlet 77, and an outlet 78. The internal cavity extends between inlet 77 and outlet 78. Inlet 77 and outlet 78 receive first end 71 and second end 73 of first channel 70, respectively. First working fluid 72 flows within and between first channel cavity 74 and the internal cavity of heat exchanger 75. Heat exchanger 75 is adapted to alter the thermal energy of the first working fluid 72 by absorbing heat from or providing heat to first working fluid 72. In one embodiment, heat exchanger 75 cools first working fluid 72 such that first thermal element 40 functions as a heat sink to thermoacoustic engine 30.

In one embodiment, first thermal element 40 includes a plurality of first channels 70. Each of the plurality of first channels 70 includes a cavity and a channel wall, wherein each of the cavities contains a working fluid in a similar manner as described above for first channel 70. In one embodiment, each of the channel walls connects to drive tube wall 50 such that channel 70 opens to drive tube 32 such that working fluid 72 contained within each of the plurality of channels 70 can mix or flow with heat transfer medium 38, contained within drive tube 32. As such, working fluid 72 is heated or cooled by conduction from heat transfer medium 38. In another embodiment, the plurality of channels 70 are bundled together.

In the embodiment incorporating a plurality of first channels 70, each of the plurality of first channels 70 defines a first end 71 and a second end 73 opposite the first end 71. Similar to first channel 70, the plurality of first channels 70 are connected at their first end 71 to inlet 77 and at their second end 73 to outlet 78. As such, in one embodiment, inlet 77 and outlet 78 each contain a plurality of connection points (not shown) to receive the plurality of channels or may be fitted with a separate connection piece to facilitate connection of the channels 70 to heat exchanger 75.

In one embodiment, the connection between first channels 70 and inlet 77 or outlet 78 is constructed by drilling a hole corresponding to the cross-section of each first channel 70 in a thick plate to support first channels 70 and rigidly connecting the plate to heat exchanger 75. In another embodiment, the connection between first channels 70 and inlet 77 or outlet 78 is constructed by forming a hole in a thick plate to support the entire plurality of first channels 70. In a plate connection, the hole diameter is preferably selected to be less than half the plate thickness. Notably, each of the plurality of channels may be connected to the plate and/or cut at different angles. However, other methods of connection are known in the art and equally acceptable.

Second thermal element 42 includes a second branch or channel 80, a heat exchanger 82, and a second working fluid 84. Second branch or channel 80 is a hollow elongated member defining and extending between a first end 86 and a second end 88. Second channel 80 defines a second channel cavity 90 enclosed by a second channel wall 92. Heat exchanger 82 can be implemented with any suitable heat exchanger adaptable to have an inlet 94, an outlet 96, and an internal cavity (not shown). The internal cavity extends between inlet 94 and outlet 96. First end 86 of second channel 80 is connected to inlet 94 and second end 88 is connected to outlet 96. Second working fluid 84 is similar to heat transfer medium and flows within and between second channel cavity 90 and the internal cavity of heat exchanger 82. Heat exchanger 82 is adapted to alter the thermal energy of second working fluid 84 by absorbing heat from or providing heat to second working fluid 84. In one embodiment, heat exchanger 82 provides heat to second working fluid 84 such that second thermal element 42 functions as a heat source to thermoacoustic device 30.

Second channel wall 92 connects to drive tube wall 50 distal to regenerator 34 and proximal to distal end 54 of drive tube 32. More particularly, second channel 80 connects and opens to drive tube 32, thereby, allowing second working fluid 84 to physically mix with heat transfer medium 38 and to foster thermal exchange between heat transfer medium 38 and second working fluid 84 by conduction. Notably, the distinction between heat transfer medium 38 and second working fluid 84 is a temporal description such that at a given instance in time, the heat transfer medium 38 is the fluid contained in the drive tube 32 and the second working fluid 84 is the fluid contained in second channel 80. In actuality, heat transfer medium 38 and second working fluid 84 freely interact and interchange with one another.

In one embodiment, second thermal element 42 includes a plurality of channels 80. Each of the plurality of channels 80 defines first end 86, second end 88, cavity 90, and channel wall 92. Similar to second channel 80, each channel first end 86 of the plurality of channels 80 is connected to inlet 94, and each channel second end 88 is connected to outlet 96. As such, inlet 94 and outlet 96 may each contain a plurality of connection points to receive the plurality of channels 80 or may be fitted with a separate connection piece to facilitate connection of the channels 80 to heat exchanger 82. In one exemplary embodiment, the connection between each second channel 80 and heat exchange inlet 94 or heat exchange outlet 96 may be constructed by drilling a hole corresponding to the cross-section of each second channel 80 in a thick plate to support second channel 80 and rigidly connecting the plate to heat exchanger 82. In another embodiment, the connection between second channels 80 and inlet 94 or outlet 96 is constructed by forming a hole in a thick plate to support the entire plurality of second channels 80. In a plate connection, the hole diameter is preferably selected to be less than half the plate thickness. Notably, each of the plurality of channels may be connected to the plate and/or cut at different angles. However, other methods of connection known in the art are equally acceptable.

Each cavity within the plurality of channels contains and allows flow of a working fluid in a similar manner as described above for second channel 80 and second working fluid 84. Similarly, each channel 80 connects and opens into drive tube 32 such that the working fluid contained within each of the plurality of channels can mix or flow with heat transfer medium 38, contained within drive tube 32. As such, the working fluid contained within each of the plurality of channels is heated or cooled upon interaction with heat transfer medium 38 by conduction. In one embodiment, the plurality of channels 80 are bundled together. In order for thermoacoustic engine 30 to function in an efficient manner, first channel 70, second channel 80, and/or the plurality of channels are acoustically isolated to decrease the amount of oscillatory flow within each channel 70 or 80. Acoustically isolating first and second channels 70, 80, decreases or prevents the first and second channels 70, 80 from intercepting or detracting from the acoustic waves traveling within drive tube 32 to decrease oscillatory flow, consequently, decreasing overall acoustic losses within thermoacoustic engine 30. Furthermore, by acoustically isolating first and second channels 70, 80, the thermal exchange design is decoupled from the acoustic design, thereby allowing each design to be independently optimized within economic constraints.

In order to be acoustically isolated from drive tube 32, first channel wall 76, second channel wall 92, and/or the plurality of channel walls must be sufficiently rigid to satisfy the boundary conditions. In one embodiment, the boundary condition is satisfied by ensuring that the ratio of the cross-section of cavity 74 or 84 to the thickness of the corresponding channel wall 76 or 86 is sufficiently small. In an alternative embodiment, the boundary condition is satisfied by bundling the plurality of channels together to support each other, thereby allowing thinner individual channel walls to be utilized.

To limit oscillatory flow and acoustic losses and to effectively decouple the acoustic and thermal aspects of thermoacoustic engine 30, first and second channels 70, 80 are sized to prevent propagation of the acoustic wave within the first or second channel 70, 80. In general, first channel 70 and second channel 80 each have a small channel cross-section compared to the wavelength of the acoustic wave produced by acoustic resonator 36. A relatively small channel cross-section prevents propagation of the wave and causes the wave to decay exponentially along the length of the channel. In particular, for any channel (e.g., rectangular or circular) there are wave modes that will propagate down the tube and, thereby, cause acoustic losses to the wave within drive tube 32. However, when both side lengths of a rectangular channel or a diameter of a circular channel drops below a critical dimension relative to the wavelength of the acoustic wave within drive tube 32, the acoustic wave will no longer propagate down the channel. Rather, if the side length or diameter is below the critical dimension, the intensity of the acoustic wave decays exponentially, dependent on the ratio of the wavelength to the diameter or length of the tube, along the length of the channel. The frequency at which an acoustic wave ceases to propagate within a channel is called the duct cutoff frequency. As such, first and second channels 70, 80 are sized to have duct cutoff frequencies lower than the duct cutoff frequency of the acoustic resonator 36 and/or drive tube 32, as further described below.

Figure 3A:
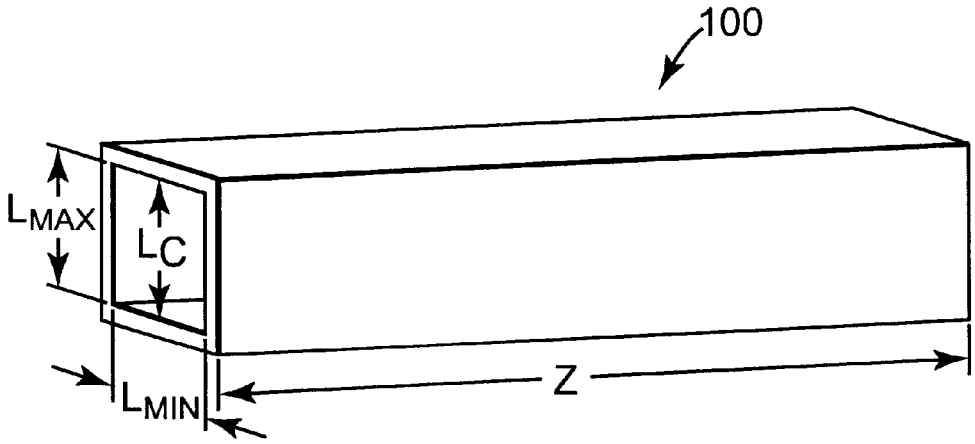
FIG. 3A is a schematic illustration of one embodiment of a channel of a thermoacoustic engine in accordance with the present invention.

FIG. 3A generally illustrates a portion of one embodiment of a first or second channel 70 or 80 as a rectangular channel 100. Rectangular channel 100 is formed from rigid sides or boundaries and has a constant rectangular cross-section. The cross-sectional dimensions are $L_{min}$ and $L_{max}$. For purposes of duct cutoff frequency, $L_{max}$ is a critical dimension $L_c$. The lowest propagating wave mode ($k_{lm}$) for rectangular channel 100 is given by the following equation:

$$k_{lm} = \frac{\pi}{L_c}$$

As such, any wave having a mode less than $\pi/Lc$ is a non-propagating wave otherwise known as an evanescent wave. Further, any sound propagating into rectangular channel 100 can be reduced to any arbitrary level by designing rectangular channel 100 to have a sufficiently small ratio of critical dimension $L_c$ to a wavelength $\lambda$ and sufficiently long channel length z to allow for full decay of the wave within rectangular channel 100, thereby, limiting oscillatory flow within rectangular channel 100. The basis for this reasoning is the following wave equation and solution known in the art (e.g., see Lawrence E. Kinsler, et al., *Fundamentals of Acoustics* (3d ed. John Wiley & Sons 1982)):

$$P_{lm}=A_{lm}\cos(k_{lm}x)\cos(k_{my}y)\exp(k_z z)e^{iwl} \text{ and}$$

$$k_z = \left(-\sqrt{k_{lm}^2 - \left(2\frac{\pi}{\lambda}\right)^2}\right)$$

Substituting the $k_{lm}$ value for rectangular channel 100 into the wave equation, the exponential in the wave equation can be written as the following:

$$\exp\left(-\sqrt{\left[\pi^2 - \left(2\frac{\pi L_c}{\lambda}\right)^2\right]}\left(\frac{z}{L_c}\right)\right)$$

Accordingly, as the ratio of critical dimension $L_c$ to the wavelength $\lambda$ becomes small compared to $k_{lm}$, the constant term of the exponent will approach $\pi$. In order for this approximation to hold true to within about one percent, the ratio of critical dimension $L_c$ to the wavelength $\lambda$ must be less than about 0.141 times the wavelength. Thus for practical situations the wave propagating into rectangular channel 100 can be reduced by a factor of twenty decibels if the length of rectangular channel 100 is at least:

$$\frac{z}{L_c} = \frac{2.303}{3.141} = 0.829$$

Notably, the ratio between length z of rectangular channel 100 and critical dimension $L_c$ is preferably chosen to be as small as possible within economic restraints and in view of other considerations to limit the distance the evanescent wave penetrates into rectangular channel 100, to reduce acoustic losses in thermoacoustic engine 30 and oscillatory flow in rectangular channel 100.

Figure 3B:
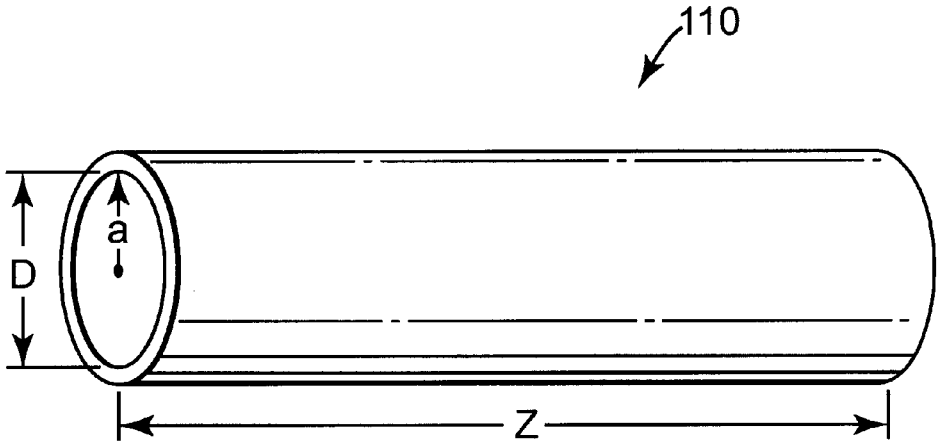
FIG. 3B is a schematic illustration of another embodiment of a channel of a thermoacoustic engine in accordance with the present invention.

FIG. 3B generally illustrates a portion of one embodiment of a first or second channel 70 or 80 as a circular channel 110. Circular channel 110 is formed of rigid sides or boundaries. Circular channel 110 has a constant cross-section, a radius a, and a diameter D, wherein diameter D is the critical dimension $L_c$ for duct cutoff frequency purposes. The lowest propagating wave mode ($k_{lm}$) for circular channel 110 is given by the following equation:

$$k_{lm} = \frac{1.841}{a}$$

As such, any wave having a mode less than 1.841/a is an evanescent wave. The acoustic wave propagating into circular channel 110 can be reduced to any arbitrary level by designing circular channel 110 to have a sufficiently small ratio of critical dimension $L_c$ to a wavelength $\lambda$ and a sufficiently long length z to allow for full decay of the wave within circular channel 110. The basis for this reasoning is the wave equation and the solution utilized above with respect to rectangular channel 100. Substituting the values for circular channel 110 into the wave equation, the exponential in the wave equation can be written as the following:

$$\exp\left(-\sqrt{\left[1.841^2 - \left(\frac{\pi L_c}{\lambda}\right)^2\right]}\left(\frac{z}{L_c}\right)\right)$$

Accordingly, as the ratio of critical dimension $L_c$ to wavelength $\lambda$ becomes small compared to $k_{lm}$, the constant term of the exponent will approach 1.841. In order for this approximation to hold true to within about one percent, the ratio of critical dimension $L_c$ to the wavelength $\lambda$ must be less than about 0.108 times the wavelength. Thus, for practical situations the wave propagating into circular channel 110 can be reduced by a factor of twenty decibels if the length of circular channel 110 is at least:

$$\frac{z}{L_c} = \frac{2.303}{1.841} = 1.25$$

Notably, as described above the lower the ratio of length z of circular channel 110 to the critical dimension the lower the acoustic losses in thermoacoustic engine 30 and the lower the oscillatory flow within circular channel 110. Accordingly, rectangular channel 100 more efficiently reduces loss and oscillatory flow based upon the ratio of channel length to critical dimension. However, it should be noted that rectangular channel 100 is more difficult to machine, which typically leads to increased losses in rectangular channel 100. As such, which channel type has lower amounts of oscillatory flow and leads to fewer acoustic losses within thermoacoustic engine 30 is a function of multiple machine and design variables.

In a preferred embodiment, critical dimension $L_c$ is small compared to the wave length of the highest significant harmonic present in the acoustic wave. In addition, channel length z is preferably similar to a length $L_R$ of regenerator 34. More preferably, channel length z is less than a length $L_D$ of drive tube 32. Moreover, channel length z is commonly determined based upon additional factors such as required working flow rate and achievable pressure, heat, and friction losses at inlet 94, through heat exchanger 82, and at outlet 96.

Further considerations must be taken when designing channels for use with Helmholtz resonator, described above. In particular, the cross-sectional dimensions of the channel are selected to have a significantly higher Helmholtz mode than the Helmholtz resonator. A resonant frequency $\omega$ for a Helmholtz resonator is expressed as:

$$\omega = c\left(\frac{A}{L'V}\right)^{1/2}$$

Where c is a speed of sound, A is an effective cross-sectional area of channel 100 or 110, L' is the effective length of neck 66, and V is the volume of acoustic cavity 56. Preferably, the channels are designed such that the Helmholtz resonance frequency is as small as possible. More particularly, the channels are designed so as the ratio of effective channel area A to effective length L', i.e. A/L', is as small as possible, consistent with other restraints, such that first and second thermal elements 40, 42 will have a significantly different (preferably lower) Helmholtz resonance, as is known in the art, than acoustic resonator 36.

Although illustrations and calculations are provided for channels having rectangular or circular cross-sections, channels having other cross-sections remain within the scope of the present invention. Furthermore, although the design process is enumerated for first channel 70 and second channel 80 similar considerations and calculations would comprise the design of a plurality of channels 70 or 80 in either first thermal element 40 or second thermal element 42. Notably in practice either plurality of channels 70 or 80 may contain hundreds of channels. In one embodiment, each plurality of channels 70 and 80 contains 10–30 channels. Within each of the plurality of channels 70 and 80, the ratio of channel length z to critical length $L_c$ may be the same or may vary for each channel within the plurality of channels. Likewise, the cross-sectional shapes of each channel may be the same or may vary within the plurality of channels.

Referring again to FIG. 2, during use of thermoacoustic engine 30, acoustic resonator 36 stores and transfers an acoustic wave to heat transfer medium 38, thereby driving heat transfer medium 38 through drive tube 32 by oscillatory flow. Heat transfer medium 38 passes through drive tube 32 past first thermal element 40, through regenerator 34, and past second thermal element 42. In a preferred embodiment, first working fluid 72 is pre-cooled and functions to cool heat transfer medium 38 by conduction as heat transfer medium 38 contacts or mixes with first working fluid 72. In one embodiment, pre-cooled first working fluid 72 is continuously or periodically injected into the first channel 70 of the first thermal element 40. The now cooled heat transfer medium 38 passes through regenerator 34 cooling the internal surfaces of regenerator 34.

Being driven through drive tube 32 by the acoustic wave, heat transfer medium 38 passes from regenerator 34 past and through second thermal element 42, which is either pre-heated or pre-cooled by heat exchanger 82. The interaction and thermal difference between heat transfer medium 38 and second working fluid 84 induces thermal exchange by conduction between heat transfer medium 38 and second working fluid 84. In one embodiment, second thermal element 42 provides heat to heat transfer medium 38. Accordingly, heat transfer medium 38 absorbs heat from second working fluid 84 to effectively heat transfer medium 38 and cool second working fluid 84. As such, in this embodiment thermoacoustic engine 30 functions as a refrigerator. Following thermal exchange between heat transfer medium 38 and second thermal element 42 in a standing wave embodiment, the acoustic wave within the heat transfer medium 38 is reflected off distal end 54 and redirected back towards resonator 36 to repeat the cyclic process.

Notably, after being cooled by heat transfer medium 38, second working fluid 84 is continually routed or circulated through and heated by heat exchanger 82, routed back to drive tube 32 in a pre-heated state, cooled again by heat transfer medium 38, and routed through the cyclic process again. In this manner, conduction between heat exchanger 82 and second working fluid 84 not only heats second working fluid 84 but also cools heat exchanger 82. In an alternative embodiment, first heat exchanger 40 may provide heat to heat transfer medium 38 and second heat exchanger 42 may absorb heat from heat transfer medium 38 such that thermoacoustic engine 30 functions as a heating apparatus.

For other embodiments in which first thermal element 40 includes a plurality of channels 70, each channel within the plurality of channels 70 functions in a similar manner as described above with respect to first channel 70. Similarly, for embodiments in which second thermal element 42 includes a plurality of channels 80, each channel within the plurality of channels 80 functions in a similar manner as described above with respect to second channel 80.

Figure 4:
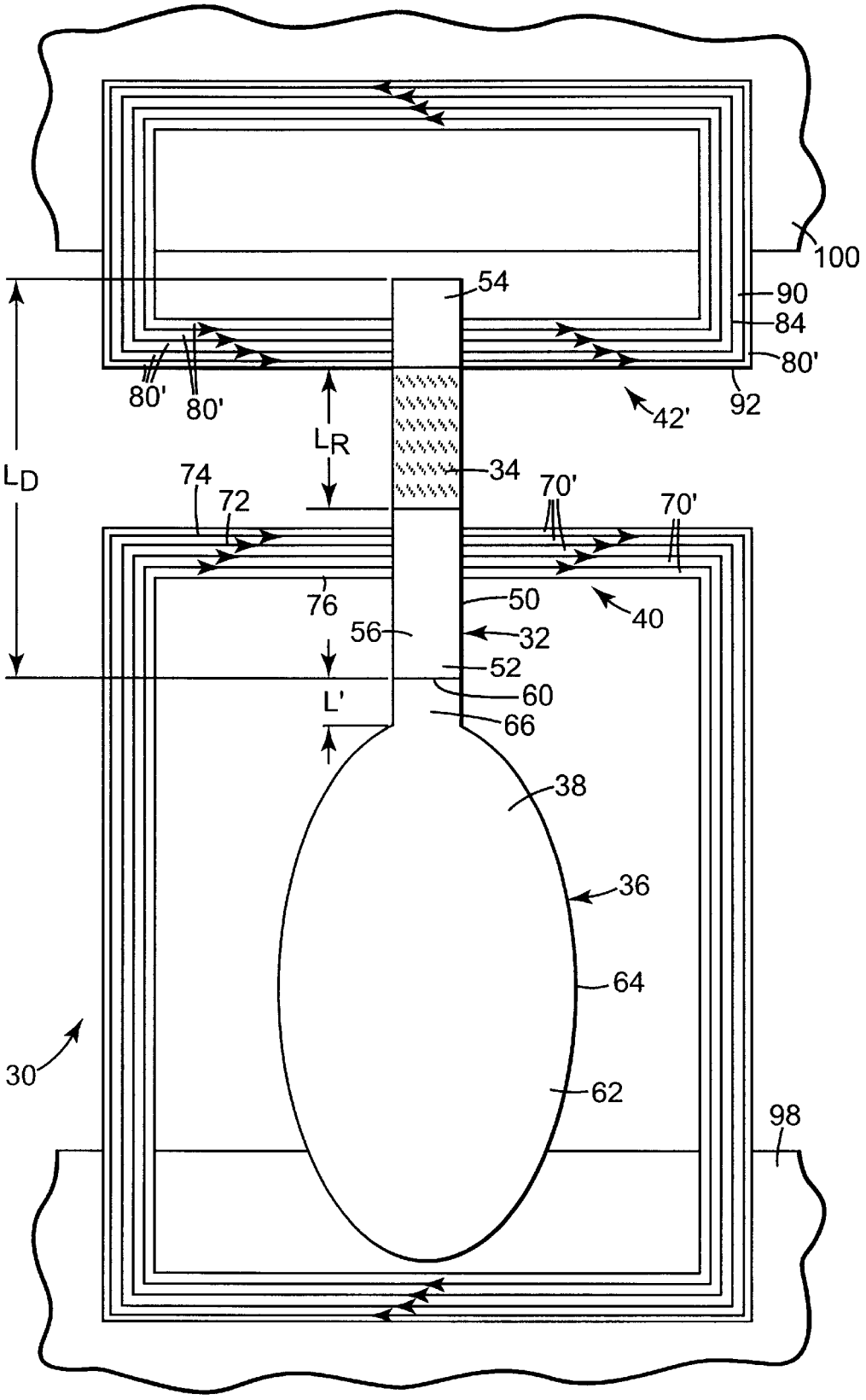
FIG. 4 is a schematic illustration of another embodiment of a thermoacoustic engine in accordance with the present invention.

FIG. 4 generally illustrates another embodiment of the first and second thermal elements generally at 40' and 42'. First thermal element 40' includes a first channel 70' and a first working fluid 72. First channel 70' is sized and shaped according to similar considerations as described above with respect to first channel 70. However, rather than being connected to heat exchanger 75 (FIG. 2), first channel 70' forms a closed loop. The closed loop is routed through an external device or environment 98, and first channel 70' independently contains first working fluid 72.

During operation, first working fluid 72 flows through first channel 70' through external device 98. External device 98 absorbs heat from or provides heat to first working fluid 72 by conduction. First working fluid 72 flows through first channel cavity 90 from external device 98 into drive tube 32 where it interacts with and undergoes thermal exchange with heat transfer medium 38. Preferably, the thermal exchange of first working fluid 72 with external device 98 is the opposite of the thermal exchange of first working fluid 72 with heat transfer medium 38. For example, if first working fluid 72 absorbs heat from external device 98, first working fluid 72 preferably provides heat to heat transfer medium 38. Alternatively, if first working fluid 72 provides heat to external device 98, first working fluid 72 preferably absorbs heat from heat transfer medium 38. In this manner, first channel 70' and first working fluid 72 interact to function as a heat exchanger eliminating the need for an additional heat exchanger and, therefore, reducing the weight and cost of themoacoustic engine 30. However, the increase in the channel length of first channel 80 would likely require active pumping of first working fluid 72, and thereby, introduce moving parts and additional reliability obstacles to thermoacoustic device 30. In one embodiment, first thermal element 40' includes a plurality of first channels 70'. Each of the plurality of channels 70' has similar properties as described with respect to first channel 70'.

Second thermal element 42' is formed in a similar manner as described with respect to first thermal element 40'. As such, second thermal element 42' includes a second channel 80' and second working fluid 84. Second channel 80' forms a closed loop, which is routed through an external device 100, and second channel 80' independently contains second working fluid 84. Accordingly, second thermal element 42' functions to absorb or provide heat to heat transfer medium in a similar manner as described above with respect to first thermal element 40'. In one embodiment, second thermal element 42' includes a plurality of second channels 80'. Each of the plurality of channels 80' has similar properties as described with respect to second channel 80'.

Notably, in one embodiment, thermoacoustic engine 30 includes first thermal element 40 and second thermal element 42' or first thermal element 40' and second thermal element 42. In another embodiment, a plurality of looped channels extend from drive tube 42. Each of the plurality of channels functions in a similar manner as described above with respect to the second channel 80' In yet another embodiment, thermoacoustic engine 30 may include one of first or second thermal element 40 or 42 in accordance with the present invention while including the remaining thermal element 40 or 42 in accordance with prior art.

The acoustically isolated heat element of the present invention provides an efficient system and method of thermal exchange for use with a thermoacoustic engine. The external thermal elements decrease structural interference and are designed to prevent wave propagation within the external thermal elements thereby decreasing overall acoustic losses with the thermoacoustic engine. Moreover, the acoustically isolated design of the external thermal element (s) decouples the design of acoustic chambers and corresponding heat exchangers to allow for independent optimization of both such elements of a thermoacoustic engine.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A thermoacoustic engine for acoustically driving a thermal exchange, the thermoacoustic engine comprising:

a hollow drive tube;

a heat transfer medium partially contained in the hollow drive tube;

an acoustic resonator connected to and opening into the hollow drive tube, the acoustic resonator being adapted to store acoustic energy and deliver at least one acoustic wave to the heat transfer medium, the at least one acoustic wave imparting motion to the heat transfer medium; and a first thermal element including:

a first channel positioned to cross and open into the hollow drive tube, the first channel being sized to decrease propagation of the at least one acoustic wave within the first channel; and a first working fluid at least partially contained within the first channel, wherein the first working fluid is adapted to interact and undergo thermal exchange with the heat transfer medium by conduction.

2. The thermoacoustic engine of claim 1, wherein the first channel is sized to procure exponential decay of the acoustic waves within the first channel.

3. The thermoacoustic engine of claim 2, wherein the first channel has a duct cutoff frequency smaller than a duct cutoff frequency of the hollow drive tube.

4. The thermoacoustic engine of claim 3, wherein the first channel has a critical dimension smaller than a dimension required for propagation of the at least one acoustic wave.

5. The thermoacoustic engine of claim 1, wherein the first working fluid is pre-heated, and the first thermal element is a heat source for the thermoacoustic engine.

6. The thermoacoustic engine of claim 1, wherein the first channel is adapted to refrigerate an external device.

7. The thermoacoustic engine of claim 1, wherein the first thermal element further includes:

an external heat exchanger connected and open to a first end and a second end of the first channel, the external heat exchanger adapted to alter the thermal energy within the first working fluid.

8. The thermoacoustic engine of claim 1 further comprising:

a second thermal element spaced from the first thermal element, the second thermal element including:

a second channel positioned to cross and open into the hollow drive tube, the second channel being sized to decrease propagation of the at least one acoustic wave within the second channel, and a second working fluid at least partially contained within the second channel, wherein the second working fluid is adapted to interact and undergo thermal exchange with the heat transfer medium.

9. The thermoacoustic engine of claim 8, wherein the second working fluid is pre-cooled, and the second thermal element is a cold sink for the thermoacoustic engine.

10. The thermoacoustic engine of claim 1, wherein the at least one acoustic wave is at least one standing wave.

11. The thermoacoustic engine of claim 1, wherein the at least one acoustic wave is at least one traveling wave.

12. A thermoacoustic engine for producing at least one acoustic wave, the thermoacoustic engine comprising:

a drive tube;

an acoustic resonator connected to and opening into the drive tube;

a heat transfer medium contained within the drive tube and the acoustic resonator;

a first thermal element including:

a first channel positioned to cross and open into the drive tube; and a first working fluid at least partially contained in the first channel, wherein the first working fluid is adapted to interact and undergo thermal exchange with the heat transfer medium by conduction; and a second thermal element spaced from the first thermal element, the second thermal element being adapted to induce thermal exchange between the second working fluid and the heat transfer medium which together with the thermal exchange between the first thermal element and the heat transfer medium produces an acoustic wave in the heat transfer medium, wherein the first channel is sized to decrease propagation of the at least one acoustic wave in the first channel.

13. The thermoacoustic engine of claim 12, wherein the first channel is sized to procure exponential decay of the acoustic wave within the first channel.

14. The thermoacoustic engine of claim 13, wherein the first channel has a duct cutoff frequency smaller than a duct cutoff frequency of the drive tube.

15. The thermoacoustic engine of claim 12, wherein the first thermal element further includes:

an external heat exchanger connected to a first end and a second end of the first channel, the external heat exchanger adapted to alter the thermal energy of the first working fluid.

16. The thermoacoustic engine of claim 12, wherein the second thermal element includes:

a second channel positioned to cross and open into the drive tube, the second channel being sized to prevent propagation of the at least one acoustic wave within the second channel, and a second working fluid at least partially contained within the second channel, wherein the second working fluid is adapted to interact with and undergo thermal exchange with the heat transfer medium by conduction.

17. A method of acoustical thermal exchange comprising:

providing a thermoacoustic engine including:

a drive tube, a heat transfer medium contained within the drive tube, a first channel positioned to cross and open into the drive tube, and a first working fluid at least partially contained within the first channel;

introducing an acoustic wave to the drive tube to induce flow within the heat transfer medium, wherein the first channel is sized to prevent propagation of the acoustic wave within the first channel; and exchanging thermal energy between the heat transfer medium and the first working fluid by conduction.

18. The method of claim 17, wherein providing a theromoacoustic engine includes sizing the first channel to procure exponential decay of the acoustic wave within the first channel.

19. The method of claim 17, wherein the first channel has a duct cutoff frequency smaller than a duct cutoff frequency of the drive tube.

20. The method of claim 17, wherein the first channel has a critical dimension smaller than a dimension required for propagation of the acoustic wave within the first channel.

21. The method of claim 17 further comprising:

providing a heat exchanger having an inlet and an outlet;

connecting a first end of the first channel to the inlet and a second end of the first channel to the outlet; and routing the first working fluid through the heat exchanger;

wherein the heat exchanger is adapted to induce thermal exchange between the heat exchanger and the first working fluid.

22. The method of claim 17 further comprising:

providing a second channel spaced from the first channel, the second channel positioned to cross and open into the drive tube, the second channel containing a second working fluid, and the second channel being sized to decrease propagation of the acoustic wave within the second channel; and exchanging thermal energy between the heat transfer medium and the second working fluid by conduction.

* * * * *